United States Patent [19]

Arter et al.

[11] 4,421,264

[45] Dec. 20, 1983

[54] VARIABLE THICKNESS SET COMPENSATION FOR STAPLER

[75] Inventors: Nelson K. Arter, Longmont; Michael A. Bartholet, Boulder; Roger D. Emeigh; Marion J. Herman, both of Longmont, all of Colo.

[73] Assignee: International Business Machines Corporation, Armonk, N.Y.

[21] Appl. No.: 277,575

[22] Filed: Jun. 26, 1981

[51] Int. Cl.[3] ..... B27F 7/17; G03G 15/00

[52] U.S. Cl. ..... 227/2; 227/4; 355/3 SH

[58] Field of Search ..... 227/2, 3, 4, 5, 6, 7, 227/8; 355/3 SH

[56] References Cited

U.S. PATENT DOCUMENTS

| | | | |
|---|---|---|---|
| 2,403,947 | 7/1946 | Oussani | 227/7 |
| 2,500,217 | 3/1950 | Taylor, Jr. | 227/7 |
| 3,058,117 | 10/1962 | Moore | 227/7 |
| 3,278,101 | 10/1966 | Hatazaki | 227/7 |
| 3,524,575 | 8/1970 | Hurkmans et al. | 227/7 |
| 4,134,672 | 1/1979 | Burlew et al. | 227/7 X |
| 4,181,248 | 1/1980 | Spehrley, Jr. | 227/3 |
| 4,187,969 | 2/1980 | Spehrley, Jr. | 227/2 |
| 4,356,947 | 11/1982 | Marshall et al. | 227/5 |

*Primary Examiner*—Paul A. Bell

*Attorney, Agent, or Firm*—Carl M. Wright; J. G. Cockburn

[57] ABSTRACT

A stapler mechanism for fastening variable thickness documents includes a stack receiving receptacle disposed between the head/hammer assembly and the clinching or anvil assembly of said stapler. A sensing device is coupled to the stapler mechanism and generates control pulses indicative of relative motion between the head/hammer assembly. A controller processes the signals and generates control signals which vary the stroke and the force driving the hammer and returns the head/hammer assembly to its home position following a stapling cycle.

11 Claims, 6 Drawing Figures

VARIABLE THICKNESS SET COMPENSATION FOR STAPLER

BACKGROUND OF THE INVENTION

1. Field of the Invention

The invention relates to stapling devices in general and particularly, to electrical staplers adapted for use with an electrophotographic device. Such staplers include a force generating device which is automatically actuated to drive a staple into a stack of sheets in order to fasten them together.

2. Prior Art

Staplers and their operation are well known in the art. Electrical staplers are more complex than the manual staplers and they include essentially the same mechanical components, i.e., an anvil or clinching device and a driver assembly. The actuating force for driving the staples is usually provided by a solenoid.

By way of example, U.S. Pat. No. 3,278,101 is a prior art stand-alone electrical stapler. In the illustrated stapler, electromechanical force powers the driver. The stapler includes a sheet receiving receptacle disposed between the anvil and driver assembly. A microswitch is disposed relative to the receptacle. Sheets to be stapled are placed in the receptacle and activate the microswitch to charge a capacitor. The capacitor charge current momentarily operates a relay having a contact that activates an electromagnet which generates a an impulse force for actuating the driver which forces a preformed staple into the sheets. The patent shows that, for force control, a capacitor with variable capacitance or an electromagnet with circuit taps may be provided to adjust the electromagnetic force produced in the electromagnet to drive the staple with a force depending upon the load on the staple. For example, the load may result from thickness of the sheets to be fastened or the number of sheets. The patent does not, however, teach how the stated characteristics, i.e., the load, relative to the sheets can be sensed and utilized to adjust the driving force.

Another type of prior art electrical stapler is primarily adapted for use with copiers. Such staplers are disposed in the copy sheet output paper path. Sets of copy sheets are formed and stapled together by the stapler. U.S. Pat. No. 4,187,969 is an example of copier-related prior art staplers. The stapler includes a housing with a passageway for storing preformed staples therein. A stationary clamping surface is connected to the passageway. A movable support surface is disposed in spaced alignment with the clamping surface. Means are provided for delivering a stack of sheets to the support surface.

In operation, the housing member with the clamping surface is held stationary. The movable support surface brings the stack of sheets into contact with the clamping surface. With the stack of sheets securely held against the clamping surface, a pneumatic operated device drives the staple into the stack.

Another type of electrical stapler primarily adapted for use with electrophotographic printers does not use preformed staples. This type of stapler is fitted with a staple forming mechanism. Usually the staple forming mechanism includes a device for cutting a predetermined length of wire from a wire supply spool. The wire is next formed into a staple. The staple is then transported into a supply magazine where it is driven into a stack of sheets. A clinching mechanism then moves into place and clinches the ends of the wires. U.S. Pat. No. 4,134,672 is an example of the last mentioned type of electrical stapler.

Often a stapler is required to bind stacks of sheets or documents of variable thickness. Variable thickness stacks usually present two problems for staplers, namely, the appropriate length of the stroke and the force which must be applied to the driving element. The length of the stroke is critical to the operation of the stapler in that if the driving element does not travel the full length of the stroke, the staple will not be ejected from the head. Similarly, if the force is not sufficient, the staple will not be driven through the stack.

The attempt of the prior art to solve the problem falls into two categories. In the first, the driving force used to drive the staple is more than is necessary. The philosophy is that by using a relatively high impact force it is assured that the staple will go through the stack. Alternately, the stapler is manually adjusted whenever the thickness of a stack changes.

Neither of these approaches satisfactory solves the variable thickness problem. The manual adjustment is unacceptable because the factor, such as paper weight, etc., which affects the stack thickness is dynamic in nature and cannot be solved by static approach in copiers. Likewise, the use of excessive force tends to waste energy and to increase the overall cost of the stapler.

SUMMARY OF THE INVENTION

It is therefore an object of the present invention to provide a stapler which is more efficient than has heretofore been possible.

It is also another object of the present invention to provide a stapler that is more efficient in coacting with a copier.

It is yet another object of the present invention to provide a stapler for fastening variable thickness stacks of sheets.

The stapler includes a support surface upon which a stack of sheets to be stapled is accumulated. A head housing assembly with a magazine for carrying staples is disposed in spaced alignment with the magazine. A driver assembly is positioned to coact with the head housing assembly and drives staples from the magazine into the stack. A mechanical linkage couples the driver assembly to a motor. A sensor means coacts with the driving assembly and generates a signal when a staple is ejected from the head housing assembly. The signal is utilized by a controller to change the energization current in the motor which returns the driver to its home position.

In another feature of the invention, a sensor means coacts with the stapler and generates a series of pulses. The pulses represent relative motion between the driver assembly and head housing assembly, respectively. The signals are processed by a controller which produces control pulses to adjust the force which is applied to the hammer assembly and to return the head and driver assembly to a home position.

The foregoing and other features and advantages of the invention will be apparent from the following more particular description of a preferred embodiment of the invention as illustrated in the accompanying drawings.

DETAILED DESCRIPTION OF THE PREFERRED EMBODIMENT

Although the present invention to be described hereinafter can be utilized as a stand-alone stapling system, it works well for stapling copy sheets outputted from a convenience copier. As such, the invention will be described in this environment. However, this should not be construed as a limitation on the scope of the present invention since it is intended that the invention can be used in any environment where it is needed for stapling sheets.

Figure 1:
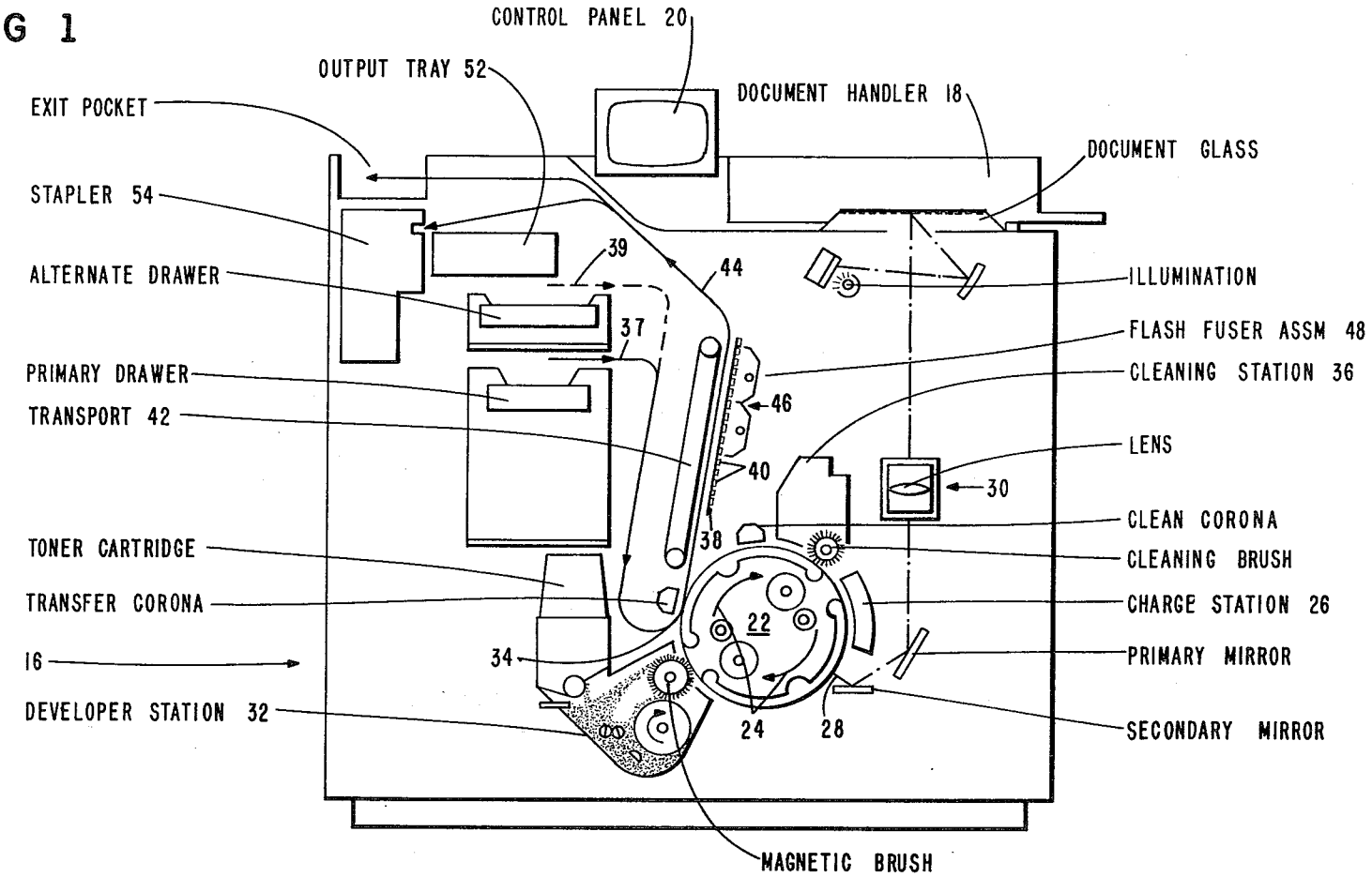
FIG. 1 is a cross-sectional diagram of an electrophotographic copier system with a stapler disposed in the copy sheet paper path.

FIG. 1 shows an electrophotographic copying system which includes a stapler 54 according to the teaching of the present invention. The electrophotographic copying system includes a copier processing engine 16, a document handler 18 and a copier control panel 20. The document handler 18 is mounted to the frame of the copier processing engine. The document handler is disposed over the document glass of the copier processing engine. The function of the document handler is to present original documents for copying to optics of the system. The use of the document handler with the copy processing engine is well known in the prior art and therefore details of the document handler will not be given.

Similarly, the copier control panel 20 is mounted to the frame of the copier processing engine 16. The function of the copier panel allows an operator to communicate to the copier processing engine. By way of example, an operator can enter the number of copy sheets that the system must generate. Also, if the operator needs stapled, collated set of copies, that information is inputted from the control panel to the system. As with the document handler, the use of copier control panels on convenience copiers is well known in the prior art and details will not be given.

Figure 2:
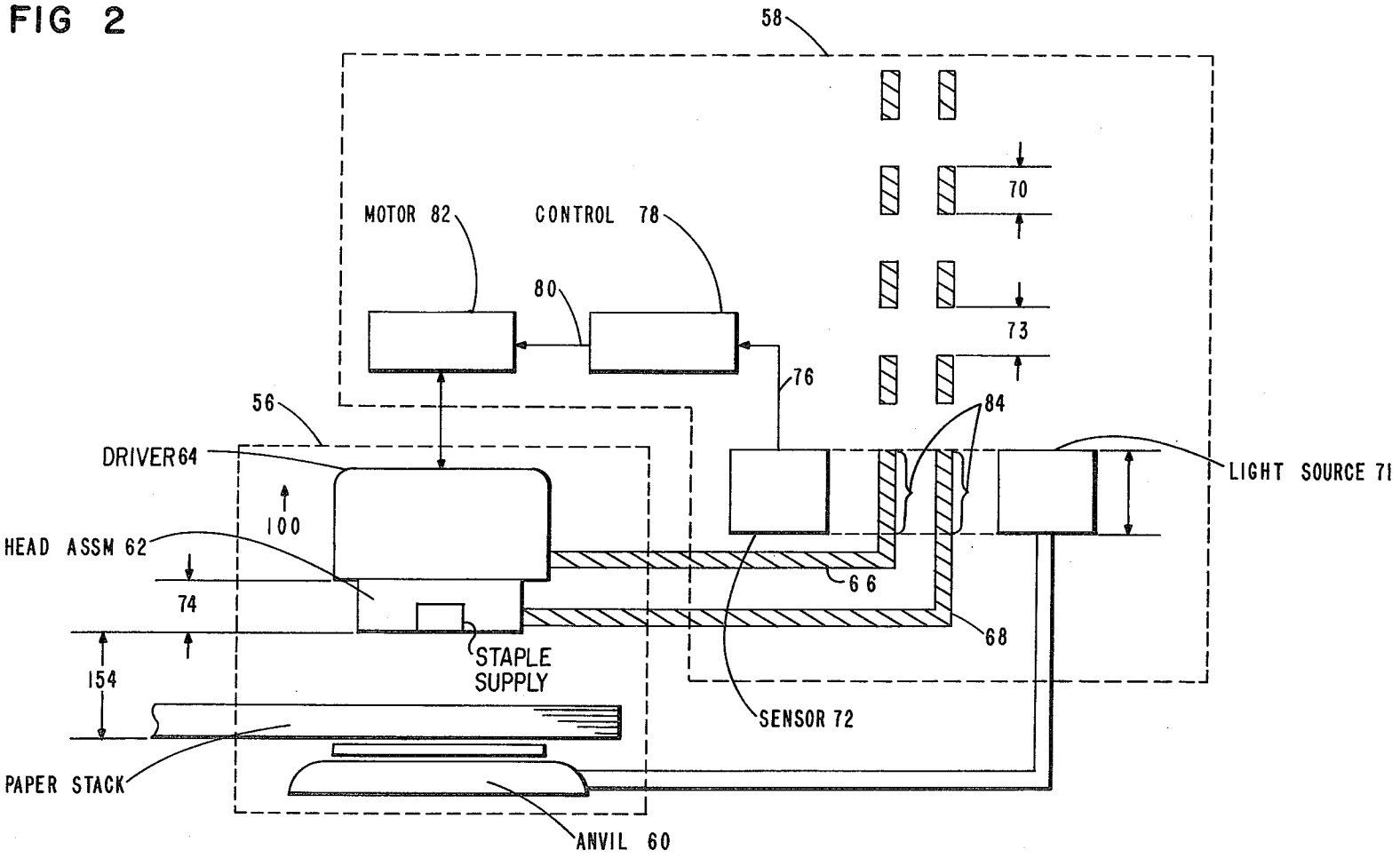
FIG. 2 is a elevation view of a stapler and a control system for driving said stapler.

FIG. 2 shows a schematic of the stapling system according to the teaching of the present invention. The stapling system includes a mechanical stapler 56 and an electrical system 58. The electrical system coacts with the mechanical stapler so that a staple is driven into a stack of sheets without the intervention of an operator. The mechanical system includes an anvil 60. The anvil is usually coupled to the frame or housing of the stapler (not shown). The anvil functions to support a stack of papers to be stapled and to clinch the ends of the staple once it is driven into the stack. Head assembly 62 is coupled to driver assembly 64 to form what is referred to hereinafter as the hammer and driver assembly. The head and driver assembly is movably mounted with respect to the anvil of the stapler. The configuration is such that the head assembly 62 is disposed above the anvil with a space between them. The spacing between the anvil and the head assembly is sufficient to accommodate a stack of paper sheets to be stapled. The head assembly 62 is fitted with a staple supple magazine. An opening (or exit slot) is contiguous with the head and staple supply. The function of the magazine or chamber is to store one or more staples and the opening enables a staple to be ejected from the head into the paper stack. The striking member (not shown) of the driver assembly is disposed so that when the driver assembly begins to move relative to the head assembly, the driver element of the driver assembly contacts a staple, forcing it out from the chamber into the stack. Although the mechanical components of the stapler are described in a particular orientation, it is well within the skill of the art to change the orientation and arrangement of the components without departing from the spirit and scope of the present invention.

The electrical system of the stapler includes a pair of linear tachometer strips 66 and 68, respectively. One of the tachometer strips 66 is mounted to driver assembly 64 and the other tachometer strip 68 is mounted to head assembly 62. The optical pattern on each of the strips is identical and includes a plurality of opaque lines 70 and transparent lines 73. These lines are shown in exploded form in FIG. 2. With identical patterns on each of the linear tachometer strips, as the strips are moved through a light beam emitted from light source 71, sensor 72 sees a steady beam of light generated through the transparent lines of the linear tachometer strip. The field of view of the sensor is much larger than the shutter spacing. As the lower surface of head assembly 62 contacts the top surface of the paper stack, the driver assembly 64 continues to move relative to the head assembly in a downward direction indicated by numeral 74. As the driver assembly moves relative to the head assembly, the dark lines or opaque lines in the tachometer strips are alternately in phase and out of phase. The sensor 72 sees a repeated series of no light and 50% light. As a result, a plurality of pulses are outputted on conductor 76. A predetermined number of pulses will correspond to the maximum distance that the driver assembly moves relative to the head assembly because the relative motion (hereinafter called the stroke) between the driver assembly and the head assembly is constant for a particular stapler. The desired relative motion, and therefore the number of pulses, is a constant independent from the variable thickness of the unknown paper stack. By counting the pulses in controller 78, adequate signals are generated on conductor 80 which drives motor 82 so that the head and driver assembly moves downward in the direction shown by numeral 74, driving a staple into the stack. The head and driver assembly is then returned to its home position. The tachometer strips need not be linear and can adopt other geometric shapes. Also, the tachometer patterns need not be precise.

Figure 3:
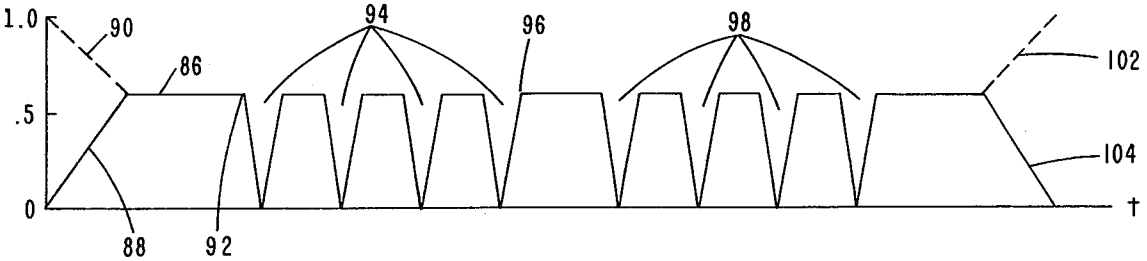
FIG. 3 is a graph of the electrical pulses generated by a sensor mechanism associated with the stapler, helpful in understanding the operation of the control system.

FIG. 3 is a plot of the electrical pulses outputted from sensor 72 (FIG. 2) as the head and driver assembly moves towards the stack. Time is plotted along the abscissa of the plot while the level of light sensed level the sensor 72 is plotted against the ordinate of the graph. Initially, the head and driver assembly is in a home position as is shown in FIG. 2. In the home position, the head and driver assembly is disposed above the anvil of the stapler. The stack of paper to be stapled is supported by the anvil or is in the process of accumulating on said anvil. The light receiving sensor 72 and the light source 71 are fixedly mounted onto the frame or housing (not shown) of the stapler. The sections 84 of the linear tachometer strips are disposed between the light source and the light sensor when the head and driver assembly is in its home position. Section 84 of the linear tachometer strips may be opaque or transparent. If section 84 is opaque, then there is no light passing from the light source 71 to the sensor 72. The signal on conductor 76 is at a low level as indicated in FIG. 3 at the point 0 of the graph. Alternately, if sections 84 of the tachometer strips are transparent then full light is passing from the light source 71 to the sensor 72 and the output signal on conductor 76 is at its highest peak indicated by the broken curve 90 of FIG. 3.

The invention is to drive the head and driver assembly downwardly as a unit by a motor drive means 82 until the head assembly contacts a paper stack. During the downward movement, since the head and driver assembly is moving as a unit, the sensor 72 detects steady light through transparent opening 73 in the tachometer strips and the output from the sensor on conductor 76 is at a steady level identified by numeral 86 in FIG. 3. With reference to FIG. 3, if the section 84 is opaque, then the output from sensor 72 on conductor 76 would generate a signal curve such as that shown by numeral 88 in FIG. 3. Alternately, if section 84 is transparent, then the signal curve on conductor 76 is that shown by numeral 90. The head and driver assembly can be determined to be in its home position according to the characteristics of curve 90 and 88, respectively, as explained below.

When the head and driver assembly moves as a unit towards the paper stack, the signal generated on conductor 76 is at the constant level shown by numeral 86. However, when the lower surface of the head assembly 62 contacts the top of the stack, the head assembly stops and the linear tachometer strip 68 which is coupled to said head assembly also stops. However, the driver assembly 64 can move a predetermined distance downwards so that the staple which is in the magazine of the head can be ejected into the paper. As was discussed previously, the distance moved by the hammer assembly when the head is trapped by the paper stack is a fixed amount. This amount is referred to as the stroke of the stapler. By monitoring the signal generated by sensor 72, one can tell when the staple is completely ejected from the head and then the direction of energization current to the motor assembly is reversed so that the head and driver assembly is pulled back in its home position.

In FIG. 3, it is assumed that the point where the lower surface of head assembly 62 contacts the top of the paper stack is identified by numeral 92. Although the motion of the head is stopped, the driver continues to move relative thereto. As the driver moves downward, the dark sections 70 on the movable tachometer strip 66 move in and out of phase with the light and dark sections on the stopped tachometer strip 68. As a result of this relative motion, a plurality of pulses identified by numeral 94 is outputted on conductor 76. The number of pulses generated will be equivalent to the stroke of the stapler. Since a specific count can be determined for this stroke, then by counting the number of pulses; these pulses are in addition to the pulse 88. It can be determined accurately when the driver is at the end of its stroke. This means the staple is ejected from the head and secured in the stack. By way of example and with reference to FIG. 3, consider that the stroke of the stapler in FIG. 2 equals a count of four. At point 96, the driver completes its stroke and is at its lowest point. At this point, controller 78, FIG. 2, would generate a reverse signal on conductor 80 which would drive motor assembly 82 in the opposite direction. Similarly, a series of pulses, identified by numeral 98, would be generated as the hammer begins to move away from the stack in the direction shown by arrow 100 (FIG. 2). As before, the controller 78 counts four pulses and at the end of this count, relative head and driver motion is complete. When the fifth pulse 104 is counted, the head hammer assembly would be in its home position. At this point, section 84 of the linear tachometer strip would be between sensor 72 and light source 71. The level of the signal would be constant and the signal on conductor 76 would be that shown by curve 102 or 104, respectively. If the section 84, which indicates the home position of the head and driver assembly, is transparent, then the signal is represented by curve 102. If section 84 is opaque, then the signal is represented by curve 104. This completes the description of one stapling cycle. The process repeats until the desired number of sets are formed.

Figure 4:
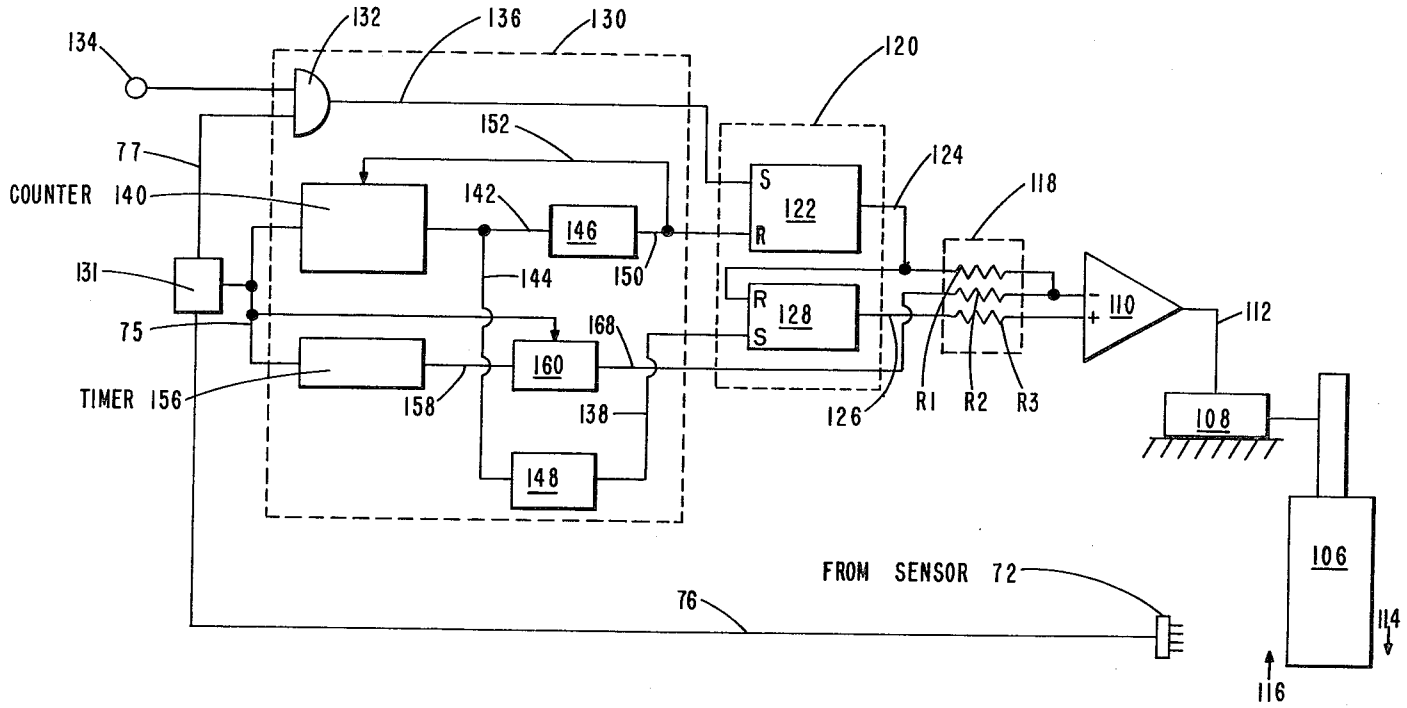
FIG. 4 is a block diagram of a controller which processes the pulses shown in FIG. 3 and generates control pulses for controlling the stapler.

In FIG. 4, a more detailed block diagram of the stapler 106 and the electrical circuit which drives the stapler is shown. Although not shown in FIG. 4, the stapler 106 includes a head and driver assembly with a means such as an anvil for accumulating a stack of documents to be stapled. The head and driver assembly of stapler 106 is driven by a motor assembly 108. The motor assembly 108 includes a rotary bidirectional conventional motor and a coupling which interconnects the output shaft of the motor to the head and driver assembly of the stapler. The function of the coupling (not shown) is to convert rotary motion to linear. By way of example, the coupling may be a cam arrangement, a rack and pinion assembly, a chain sprocket assembly, etc. A bipolar operational amplifier 110 is coupled by conductor 112 to motor assembly 108. Of course, other types of amplifiers can be used without departing from the scope of the present invention. The function of the bipolar operational amplifier 110 is to control current (or voltage) in the motor so that the head and driver assembly can be driven in a direction identified by numerals 114 or 116. A gain control means 118 is connected to the input of bipolar operational amplifier 110. In the preferred embodiment of this invention, the gain control means 118 comprises of a plurality of resistors, R1, R2 and R3, operably coupled to the input terminals of the operational amplifier. The function of gain control means 118 is to regulate the gain to the amplifier so that the current to the motor can be controlled. As will be discussed hereinafter, this enables variable force to be applied by the motor. The force depends on the thickness of the stack of sheets accumulated between the head and driver assembly and the anvil of the stapler.

A latching circuit means 120 is coupled over a plurality of conductors to the gain control means 118. The latching circuit means 120 includes forward latch 122. The function of the forward latch 122 is to energize the motor so that the head and driver assembly is driven in one direction, i.e., downwardly as is shown by numeral 114. The signal for forward motion is outputted on conductor 124. Likewise, for the motor to be driven backwards so that the head and driver assembly is transported in the direction shown by numeral 116, a signal is outputted on conductor 126 from backward motor latch 128. Each latch is set and reset from signals outputted from logical circuit means 130.

The primary function of logical circuit means 130 is to determine when the staple is fully ejected from the head assembly, when to reverse the force on the head and driver assembly and to turn the system off with the head and driver assembly in its home position. The logic circuit means 130 also determines when the force on the head and driver assembly should be changed, i.e., varied, to compensate for a change in thickness of the stack. To this end, the logical circuit means 130 includes a logical AND circuit 132. One input to the AND circuit 132 is on a conductor 134. The signal on the conductor 134 indicates that a set of sheets is accumulated between the anvil and the head and driver assembly of the stapler. This signal is usually generated by the controls of the convenience copier. The other input signal to the AND circuit is on a conductor 77 and is generated from sensor processing circuit means 131. The sensor processing circuit means 131 is a conventional circuit which accepts signals from sensor 72 (FIG. 2) on conductor the 76 and supplies a pulse on the conductor 77. The pulse on conductor 77 indicates that the head and driver assembly is in its home position. When the signals on the conductor 134 and on conductor 77 are present, the AND circuit 132 is activated and supplies a signal on a conductor 136. The signal on the conductor 136 sets the forward motor latch 122. The forward motor latch then supplies control signals on the conductor 124 through R1 to the operational amplifier 110. This signal energizes the motor and it rotates, the rotary motion being converted into linear motion to drive the head and driver assembly downwardly in the direction shown by the arrow 114. Simultaneously, the signal which is supplied from the forward motor latch 122 resets backward motor latch 128. As the head 62 (FIG. 2) contacts the stack, the linear tach 68 stops moving and the other linear tach 66 begins to move relative to linear tach 68. As this relative motion begins, this indicates that the driver assembly is moving relative to the head. A series of pulses is then supplied on conductor 76 (FIGS. 2 and 4). These pulses activate counter 140. In the preferred embodiment of this invention, the counter 140 is a conventional up/down counter. The counter is controlled so that it will count up to a maximum count, decrement that count in response to a control signal, and stop counting when the count in the counter is zero. The output signal from the counter is coupled over two conductors 142 and 144, respectively, to a comparator 146 and a comparator 148. The output from the comparator 146 is coupled by conductor 150 to the reset terminal of the forward motor latch 122 and by a conductor 152 to the control section of the counter 140. The output signal from the comparator 148 is coupled by a conductor 138 to the reset terminal of the backward motor latch 128. The pulses on conductor 76 are counted by the counter means 140. The count in the counter is supplied on the conductor 142 and is compared with a number which is set in the comparator 146. The number in the comparator 146 is the count value which is equivalent to the stroke of the hammer assembly plus the pulse 88 (FIG. 3).

By way of example, and with reference to FIG. 3, if the count of four represents the stroke of the particular stapler, then a count of five would be set in comparator 146. When the count in the counter 140 is equivalent to the count value set in the comparator 146, a signal is generated on a conductor 150 which resets the forward motor latch 122 and inhibits the counter 140 from counting upwards. Simultaneously with resetting the forward motor latch 122, the backward latch 128 is set. With the backward counter 128 set, a signal is generated on conductor 126 which drives the motor in the backward direction. The head stapler assembly then begins to move in the direction identified by the numeral 116. The pulse on conductor 76 now decrements the count in counter 140.

As the count in the counter 140 is decremented, the output is coupled by the conductor 144 to the comparator 148 which is set with a count of zero. When the count on the conductor 144 is zero, the comparator supplies a control signal on conductor 138 which resets the backward motor latch 128. At this point, the head assembly is in its home position and the cycle is completed.

It should be noted at this point that although a preferred electronic system is shown in FIG. 4, it is within the skill of the art to utilize other electronic control systems without departing from the scope of this invention. By way of example, the electronic controller can be replaced by a conventional microcomputer which is programmed to generate the appropriate signals whenever the stapler head assembly is to be driven forward and backward, respectively.

As was pointed out above, one aspect of the present invention is to apply a variable force to the head and driver assembly so that, as the thickness of the stack to be stapled varies, the appropriate force for driving the driver so that the staples can enter the stack is automatically adjusted. With reference to FIG. 2, the distance between the bottom surface of the head assembly 62 and the anvil is a measure of the thickness of the stack. By measuring the distance that the head assembly travels from its home position until the stack is contacted, the thickness of the stack can be accurately determined. The force of the motor can then be adjusted as a function of the stack height or thickness. To this end, when a thin paper stack is disposed between the anvil 60 and the head and driver assembly 62 and 64, respectively, the travel of the head assembly will be much longer than for a thick stack. For a thick stack, the travel will be relatively short. By monitoring the distance which the head and driver assembly travels prior to relative motion between the head and driver assembly, the thickness of the stack can be determined, and, as a result, the energization of the motor varied so that an appropriate force is applied to the driver.

When the head and driver assembly is moving as a unit, the output signal from the sensor 72 is at the constant level identified by curve 86, FIG. 3. If there were no paper in the stack, the constant level curve 86 would extend for a longer period of time before pulses are emitted from sensor 72. On the other hand, if the space between the anvil and the head were half filled with paper, the constant level curve 86 would extend for a shorter period of time along the time axis. It can be seen that by proportioning the space between the anvil and the lower surface of the head assembly so that the energization force which is applied to the motor is a function of the distance move by the head, one can adequately compensate for stack variation. Stated another way, when the head moves a relatively short distance from its home position toward the stack, a thick stack is sensed and a high current is fed into the motor. If the move from the home position to the stack is relatively long, the stack is thin and a lower current is used to energize the motor. The motion of the head across the gap 154 is a measure of stack thickness and is related to the energization current which is needed to drive the motor so that it does not stall because of stack thickness. By monitoring the time which elapses from the home position of the head until motion is stopped, one can change the motor current accordingly to compensate for stack thickness.

Although there are several ways in which this motion can be measured, the preferred embodiment of this invention uses a count to indicate the time elapsed for head motion. By way of example, it was observed empirically that when no sheet is between the anvil and the head assembly, a count of approximately 200 is required for the head to move from its home position until it contacts the anvil. If the capacity of the gap is 50 sheets, when the count is less than 200, e.g., 100, then approximately 25 sheets are in the stack and the energization to the motor is at one level. If the count is less than 100, the number of sheets to be stapled is greater than 25 and a higher energization current is supplied to the motor.

As shown in FIG. 4, the force adjustment feature of the present invention is achieved by a timer 156 which has its output signal on conductor 158 connected to the input of a comparator 160. The output signal from the comparator 160 is coupled through a resistor R2 which parallels the with resistor R1 which is coupled to the output from the forward latch circuit 122. It should be noted that the change or force adjustment feature is needed only when the motor is driven in the forward direction and is forcing the staple into the stack. The input signal to the timer 156 is on conductor 75. In operation, a predetermined count, e.g., 100, is set into the comparator 160. As was stated before, whenever the head contacts the stack of sheets, relative motion between the head and the driver assembly occurs and a series of pulses is generated by the tachometer processing circuit means on conductor 75. If the first pulse from the conductor 75 occurs before timer the timer value reaches 100, the driver is traveling faster than necessary so the current is decreased. If the time value exceeds 100 when the pulse occurs, the driver is traveling slower than necessary so the motor current is increased. The comparator is conventional and is controlled so that when an input value is less than its set value, a signal is supplied on the conductor 168. When the timer 156 is running, a series of signals is supplied on the conductor 158. The signals on the conductor 158 are indicative of the magnitude of the count set in the timer 156. As long as the timer count on conductor 158 is greater than the count set in the comparator 160, no signal is supplied from the comparator, and as a result, no current flows in R2 so the input resistance to operational amplifier 110 is effectively R1. However, as the first pulse 94 (FIG. 3) is supplied over conductor 76, the timer is disabled and the count on the conductor 158 is compared with the count set in the comparator 160. In the example given above, if the count is less than 100, a thick stack of sheets is in the paper accumulating zone and a signal is supplied on conductor 168, current flows in R2, and the effective resistance at the input of operational amplifier 110 changes which increases the gain of the operational amplifier 110. The current flowing in the motor also increases and the force which drives the head and driver assembly is increased. Although the force to the head and driver assembly is adjusted once, it should be noted that the force can be adjusted on a continuous basis or in a plurality of steps.

In FIG. 2, an alternate way of configuring the sensor means which senses relative motion between the head and driver assembly is that for each of the tachs 66 and 68, a separate light source (not shown) and a separate light sensor can be positioned on opposite sides of the individual linear tach. With this configuration, when the head and driver assembly moves as a unit, each sensor associated with each of the linear tachs generates a plurality of pulses. However, when the head contacts a stack of paper and its tachometer stops, pulses will continue to be generated by the sensing assembly associated with the driver. This indicates relative head and drives motion in a manner similar to that previously described, the appropriate signals being generated for forcing the driving forward into the stack and for adjusting the force needed to compensate for variable stack thickness.

The stapler of the present invention lends itself to error detection and diagnostics. By way of example, it can be determined when the head and driver assembly is in its home position, stack position, etc.

Figure 5:
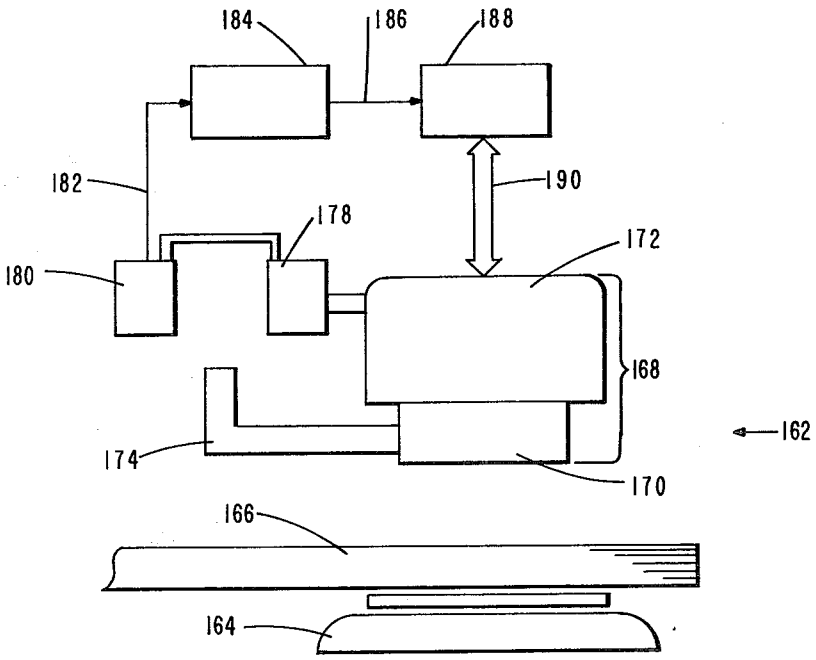
FIG. 5 shows an alternate arrangement for the sensing mechanism associated with the stapler.

FIG. 5 shows an alternate embodiment according to the teaching of the present invention. The stapling apparatus 162 includes a support means or anvil 164. As before, the function of the anvil is to support a stack of sheets 166. A head and driver assembly 168 is disposed above the anvil 164. The head and driver assembly includes a head assembly 170 and a driver assembly 172. The head assembly 170 includes a staple supply with an exit slot through which a staple can be ejected to staple stack 166. An optical mask 174 is mounted to the head assembly 170. The optical mask is opaque. A light emitting device 178 and a light receiving or light sensitive device 180 is mounted to the driver assembly 172 of the stapler. The output signal from the light sensitive device 180 is coupled over conductor 182 to controller 184. The output signal from the controller 184 is coupled over a conductor 186 to motor drive assembly 188. The output from the motor drive assembly 188 is coupled over linkage 190 to the hammer assembly 172.

In operation, when the desired number of sheets 166 have accumulated between the support means 164 and head 170, a signal is supplied from the controller 184. The signal causes the motor in the motor assembly 188 to drive the head in a downward position. As the head and driver assembly moves downward, the light emitting device 178 and the light receiving source 180 moves downwardly. The downward motion continues until the bottom surface of the head assembly contacts the top surface of the stack 166. At this point, the driver assembly begins to move relative to the head assembly. As soon as the optical mask 174 is disposed between the movable light emitting device 178 and light receiving source 180, a pulse edge is supplied on conductor 182 which indicates to the controller 184 that the staple is ejected from the head. The direction of the motor is reversed so that the head and driver assembly is returned to the home position.

Figure 6:
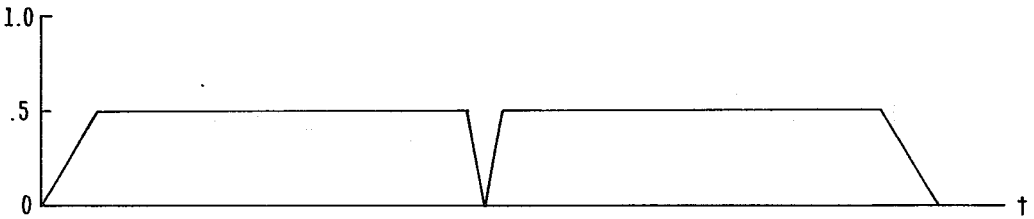
FIG. 6 is a graph showing the pulses generated by the alternate arrangement of FIG. 5.

FIG. 6 shows a graph of the single pulse which is generated from the configuration of FIG. 5 and is utilized by the controller 184 to control the force which is applied to the driver.

While the invention has been particularly shown and described with reference to a preferred embodiment, it will be understood by those skilled in the art that various changes in form and details may be made therein without departing from the spirit and scope of the invention.

What is claimed is:

1. In a stapling device having an anvil means for accumulating and supporting a stack of sheets and head means and coacting driver means for driving a staple into the stack, the improvement comprising:

sensor means coupled to the head means and the driver means for supplying control signals representative of relative motion therebetween; and controller means responsive to said control signals for driving the head means and driver means bidirectionally with variable force.

2. The stapling device of claim 1 further including force means for applying variable force to the head means and driver means.

3. The device of claim 1 wherein the sensor means includes:

light emitting source means for supplying a light beam;

light receiving means disposed in relation to the light emitting source for sensing said light beam;

first means having a plurality of alternating opaque and transparent sections thereon mounted to the head assembly for interrupting said light beam; and second means having a pluraity of alternating opaque and transparent sections thereon substantially equivalent to the sections of the first means mounted to the driver assembly, said first and second means being disposed between the light emitting means and said light receiving means.

4. An improved stapling apparatus comprising:

anvil means for supporting a stack of sheets to be stapled;

light emitting means with light receiving sensor means mounted to the anvil;

stapler head means for carrying a supply of staples disposed opposite the anvil;

driver means operably associated with the head means and movable therewith;

first light shutter means having a plurality of alternating opaque and transparent lines and mounted to the head means for moving together therewith between said light emitting means and said sensor means;

second light shutter means having a plurality of alternate opaque and transparent lines and mounted to the driver means for moving together therewith between said light emitting means and said sensor means;

motor means for driving said driver means so that a plurality of pulses is generated by the sensor when there is relative motion between the first and second light shutter means; and control means responsive to said pulses for energizing the motor means.

5. In an electrophotographic copying system having a copier engine for generating copy sheets, a sheet handling device for presenting sheets of original documents to the viewing platen of said copier engine, a finishing device for collating and stapling the copy sheets to form predetermined sets, as improved stapling device for use with the finishing device comprising:

means for accumulating a set of copy sheets;

head means and driver means for driving a staple into the stack;

force means for applying a variable force to the head and driver means;

sensor means for generating pulses representative of relative motion between the head means and said driver means; and controller means responsive to the signals for controlling the force means.

6. The improved stapling device of claim 5 further including means for clinching the ends of the staple after it is driven into the stack.

7. Stapling apparatus for fastening stacks of variable numbers of sheets comprising in combination:

accumulator means for receiving and supporting a plurality of sheets;

staple supply means disposed adjacent to said accumulator means;

driver means associated with the staple supply means for forcing a staple therefrom into said stacks;

force means for driving said driver means;

sensing means associated with the staple supply means and driver means for generating electrical pulses representative of relative motion therebetween; and controller means responsive to said pulses for controlling said force means to supply a force to said driver means proportional to the thickness of said stacks.

8. The apparatus of claim 7 further including means for clinching the end of the staple.

9. The apparatus of claim 7 wherein the force means includes a motor.

10. The apparatus of claim 7 wherein the sensing means includes light emitting source means for supplying a beam of light;

light receiving sensor means disposed in spaced linear alignment with the light emitting source for receiving said beam of light when not interrupted;

first light shutter means operably mounted to the driver assembly for interrupting said beam of light; and second light shutter means operably mounted to the staple supply means for interrupting said beam of light, said first and second light shutter means having alternate opaque and transparent patterns thereon with the patterns coacting so that the sensor supplies a first signal with a fixed level when the shutters are being transported with the patterns in linear alignment without relative motion therebetween and a series of pulses when the patterns are relatively moving.

11. The apparatus of claim 7 wherein the controller means includes a variable gain amplifier;

gain control circuit means coupled to the amplifier for controlling the gain thereof;

latching circuit means coupled to the gain control circuit means and operable to drive the force means bidirectionally; and logic circuit means for enabling the latching circuits.

* * * * *